US005923290A

United States Patent [19]

Mikami et al.

[11] Patent Number: 5,923,290

[45] Date of Patent: Jul. 13, 1999

[54] ARRAY ANTENNA APPARATUS

[75] Inventors: Akio Mikami; Kenjiro Saito, both of Tokyo, Japan

[73] Assignee: Kabushiki Kasiha Toshiba, Kawasaki, Japan

[21] Appl. No.: 08/625,961

[22] Filed: Apr. 1, 1996

[30] Foreign Application Priority Data

Mar. 31, 1995 [JP] Japan ..... 7-076462

[51] Int. Cl.[6] ..... H01Q 3/02; H01Q 3/12

[52] U.S. Cl. ..... 342/374; 343/700 MS

[58] Field of Search ..... 342/374, 375; 343/700 MS

[56] References Cited

U.S. PATENT DOCUMENTS

| | | | |
|---|---|---|---|
| 3,247,512 | 4/1966 | Diamond . | |
| 3,331,071 | 7/1967 | Preston . | |
| 3,671,973 | 6/1972 | French | 343/751 |
| 3,889,261 | 6/1975 | Sirven . | |
| 4,521,781 | 6/1985 | Campi et al. | 343/700 MS |
| 4,644,360 | 2/1987 | Mead et al. | 343/700 MS |
| 4,652,888 | 3/1987 | Deasy | 343/791 |
| 5,201,065 | 4/1993 | Niehenke | 455/83 |
| 5,206,655 | 4/1993 | Caille et al. | 343/700 MS |
| 5,243,354 | 9/1993 | Stern et al. | 343/700 MS |
| 5,309,160 | 5/1994 | Powell et al. | 342/128 |
| 5,422,649 | 6/1995 | Huang | 343/700 MS |

FOREIGN PATENT DOCUMENTS

| | | |
|---|---|---|
| 0 361 417 A2 | 4/1990 | European Pat. Off. . |
| 4-120804 | 4/1992 | Japan . |
| 4-122103 | 4/1992 | Japan . |
| 2 243 491 | 10/1991 | United Kingdom . |

*Primary Examiner*—Theodore M. Blum
*Attorney, Agent, or Firm*—Finnegan, Henderson, Farabow, Garrett & Dunner, L.L.P.

[57] ABSTRACT

Array antenna apparatus can form a beam in plural directions by changing the electrical supply track length between antenna elements of array antennas so that a beam of the same form but a different inclination angle is formed by each array antenna. Each array antennas can be arbitrarily selected switch circuit, and a supplied transmitted signal, and enables forming a beam in different directions alternatively.

2 Claims, 10 Drawing Sheets

ARRAY ANTENNA APPARATUS

TECHNICAL FIELD

This invention relates to antenna apparatus which is suitable for use in a variety of applications including missiles and artificial satellites.

DESCRIPTION OF THE RELATED ART

When performing a beam scan where the main part of antenna apparatus is fixed, although the beam scanning function for covering a large area in antenna apparatuses, such as in radar and communication applications, at high speed is required, array antenna apparatus which generally changes the excitation phase of two or more antenna elements is used.

A conventional array antenna apparatus using the above-described method is explained with reference to FIG. 9.

FIG. 9 shows elements of the conventional array antenna apparatus for a radar application which changes an excitation phase, by equipping antenna elements with a phase shifter.

The distribution composition vessel 10 carries out an n (n is an integer) distribution of the transmitted signal supplied from a transmitting vessel (not shown) at the time of transmission, and supplies it to the phase shifters 21-1,21-2, . . . ,21-n, respectively. The vessel 10 also combines the received signals supplied from phase shifters 21-1,21-2, . . . ,21-n at the time of reception, and outputs the combined result to a receiver (not shown).

Phase shifters 21-1,21-2, . . . ,21-n perform phase control for an antenna beam scan, and they control the phase of the transmitted signal supplied from the distribution composition vessel 10 at the time of transmission according to the value of a phase shift control signal from control equipment 40 described more fully below, and supply the transmitted signal to antenna elements 31-1,31-2, . . . ,31-n, respectively, for transmission. Phase shifters 21-1,21-2, . . . ,21-n also control the phase of the received signal supply from antenna elements 31-3n at the time of reception, respectively, and supply it to the distribution composition vessel 10.

While the antenna elements 31-1,31-2, . . . ,31-n emit to space the transmitted signal for which phase control was carried out by the phase shifters 21-1,21-2, . . . ,21-n, they can also receive the radar echo from an observed object, and supply it to the phase shifters 21-1,21-2, . . . ,21-n as a received signal, respectively. The control equipment 40 generates the phase shift control signal in accordance with a control signal, which is outputted to the phase shifters 21-1,21-2, . . . ,21-n, and controls phase shift.

The conventional array antenna apparatus distributes the transmitted signal by means of the distribution composition vessel 10 at the time of transmission, and carries out a beam scan of the target direction by performing phase control further at the phase shifters 21-1,21-2, . . . ,21-n. After the antenna elements 31-1, 31-2, . . . ,31-n receive the radar echo from an observed object at the time of reception and carry out phase control by means of the phase shifters 21-1,21-2, . . . ,21-n the received signals are combined by the distribution composition vessel 10 to obtain the received signal.

However, with respect to the conventional array antenna apparatus having n antenna elements and phase shifters, since many phase shifters and associated control equipment were needed, there was a problem that the system was complicated and it was difficult to provide a miniaturized and lightweight construction of the conventional array antenna apparatus.

There is also conventional array antenna apparatus which does not use phase shifters. In such array antenna apparatus an excitation phase is changed by changing the frequency of a transmitted signal.

An example of such apparatus is shown in FIG. 10.

The array antenna apparatus generally shown in FIG. 10 includes patch-like antenna elements distributed on the surface of a substrate 50. The antenna elements are connected in series to receive an electrical signal power supply by an electrical supply track 70, with the signals being supplied at one end of the track 70. An element of the array so connected, is supplied with signals provided by a frequency variable vessel 80.

That is to say, the phase adjustment in each antenna elements 61-1,61-2, . . . ,61-n is controlled by the frequency variable vessel 80, and is made to form a beam in the target direction by changing the frequency of a transmitted signal.

However, because there are restrictions on permissible frequency bands that can be used for the antenna elements 61-1,61-2, . . . ,61-n, with the conventional array antenna apparatus as described above, there was a problem that a beam inclination angle could not be selected arbitrarily by changing the frequency of a transmitted signal.

Furthermore, it was difficult to suppress extraneous wave forms, and to change to rectangular polarization.

SUMMARY OF THE INVENTION

It is an object of the invention to overcome the above described deficiencies of conventional systems. In accordance with the invention there is provided array antenna apparatus, comprising: two array antennas each having a beam inclination angle characteristic and each including a plurality of antenna elements connected in series to conduct electrical power applied thereto; and a switch circuit for selectively directing transmission signals to the two array antennas and received signals from the two array antennas and for determining the beam inclination angle characteristic of the array antenna apparatus by selecting one of the array antennas.

DETAILED DESCRIPTION OF THE PREFERRED EMBODIMENTS

The embodiments of the invention will be explained with reference to the accompanying drawings.

Figure 1:
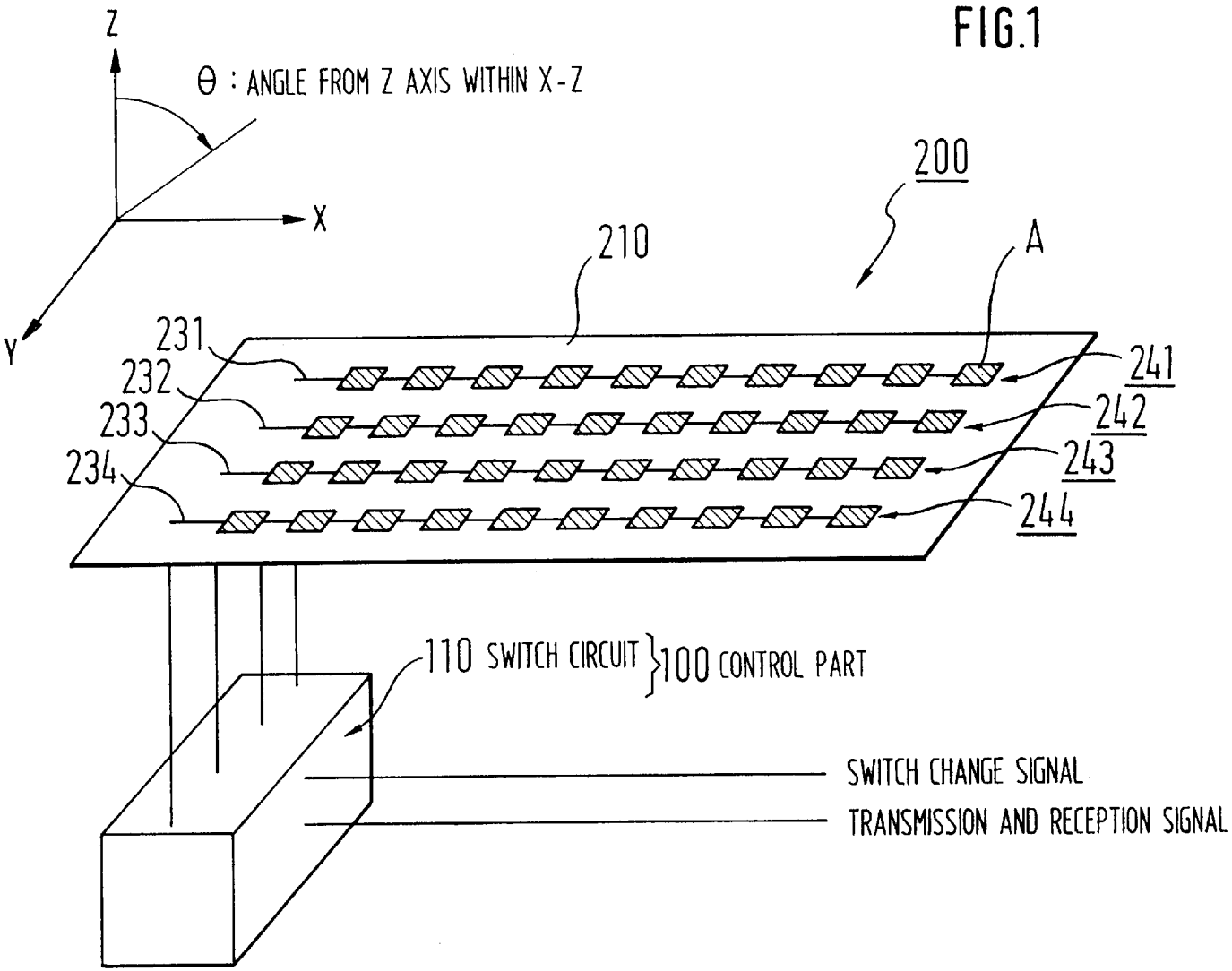
FIG. 1 illustrates array antenna apparatus in accordance with a first embodiment of the invention.

FIG. 1 illustrates array antenna apparatus in accordance with a first embodiment of the invention, and is adapted for use in a radar application.

The array antenna apparatus of FIG. 1 comprises a control part 100 and an antenna part 200. The control part 100 includes a switch circuit 110. The antenna part 200 includes array antennas 241–244 to which switch circuit 110 is connected switch circuit 110 is coupled to receive a transmitted signal and a switch change signal supplied from a transmitting vessel (not shown). In response, the switch circuit 110 outputs a transmitted signal to the array antennas 241–244 alternatively according to the switch change signal.

Each of array antennas 241–244 comprises two or more antenna elements A distributed on the surface of a substrate 210. Each antenna element A is a patch that occupies a discrete limited area, having a predetermined shape, e.g., a square. The antenna elements A are formed of a dielectric and the substrate is an insulating material. Thus, the antenna elements A arranged as the array antenna 241–244 on the substrate 210 form the antenna part 200.

While antenna elements A emit a transmitted signal into space, the radar echo from an observed object is received by the elements A. Electrical signal power is supplied to each antenna element by four electrical supply tracks 231–234 which connect the elements A of each array in series, thereby forming the four sets of array antennas 241–244.

The ends of the electric-supply tracks 231–234 are connected to the switch circuit 110 of the control part 100 to receive electrical power.

Figure 2:
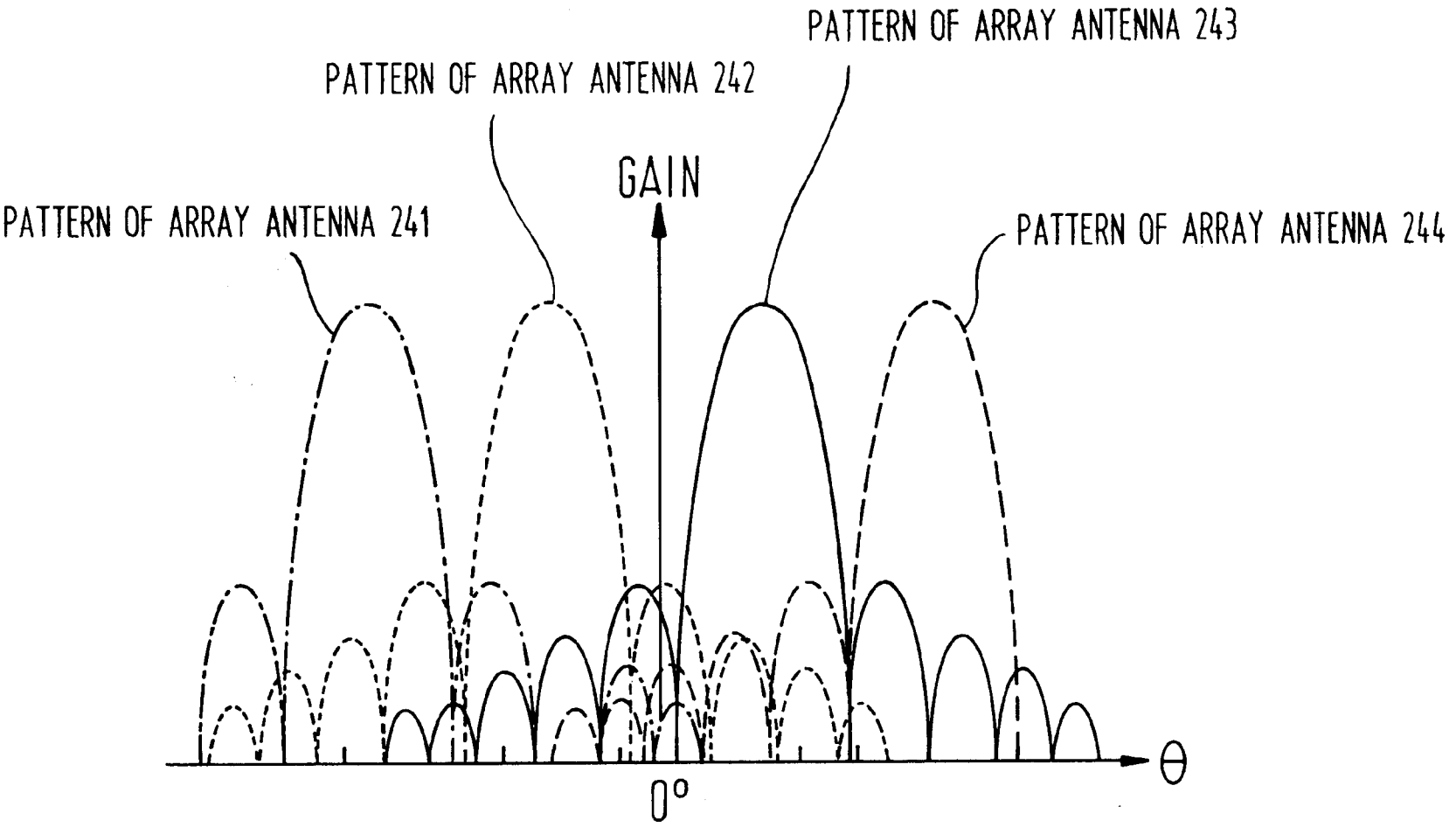
FIG. 2 illustrates a radiation pattern of each array antenna of the antenna apparatus of the first embodiment.

Moreover, although the array antennas 241–244 each form a beam of the same form as shown in FIG. 2, there is a different electric-supply track length between the antenna elements A for each array antenna, which results in a beam having an inclination angle which changes with the track length between elements.

Hereafter, operation of the array antenna apparatus of the first embodiment is explained.

The transmitted signal from a transmitting vessel is supplied to one of the array antennas 241–244 chosen by the switch circuit 110 in accordance with the switch change signal, and is emitted into space from each antenna element A. Since the beam inclination angle of each of array antennas 241–244 differs mutually, when selection of the array antennas 241–244 is switched, a beam will be alternatively formed in a different one of four directions.

A received signal is generated from a radar echo from an observed object is processed in a reverse to that described for a transmitted signal.

Therefore, according to the array antenna apparatus of the first embodiment, a beam can be alternatively formed in four different directions, without using phase shifters.

Figure 3:
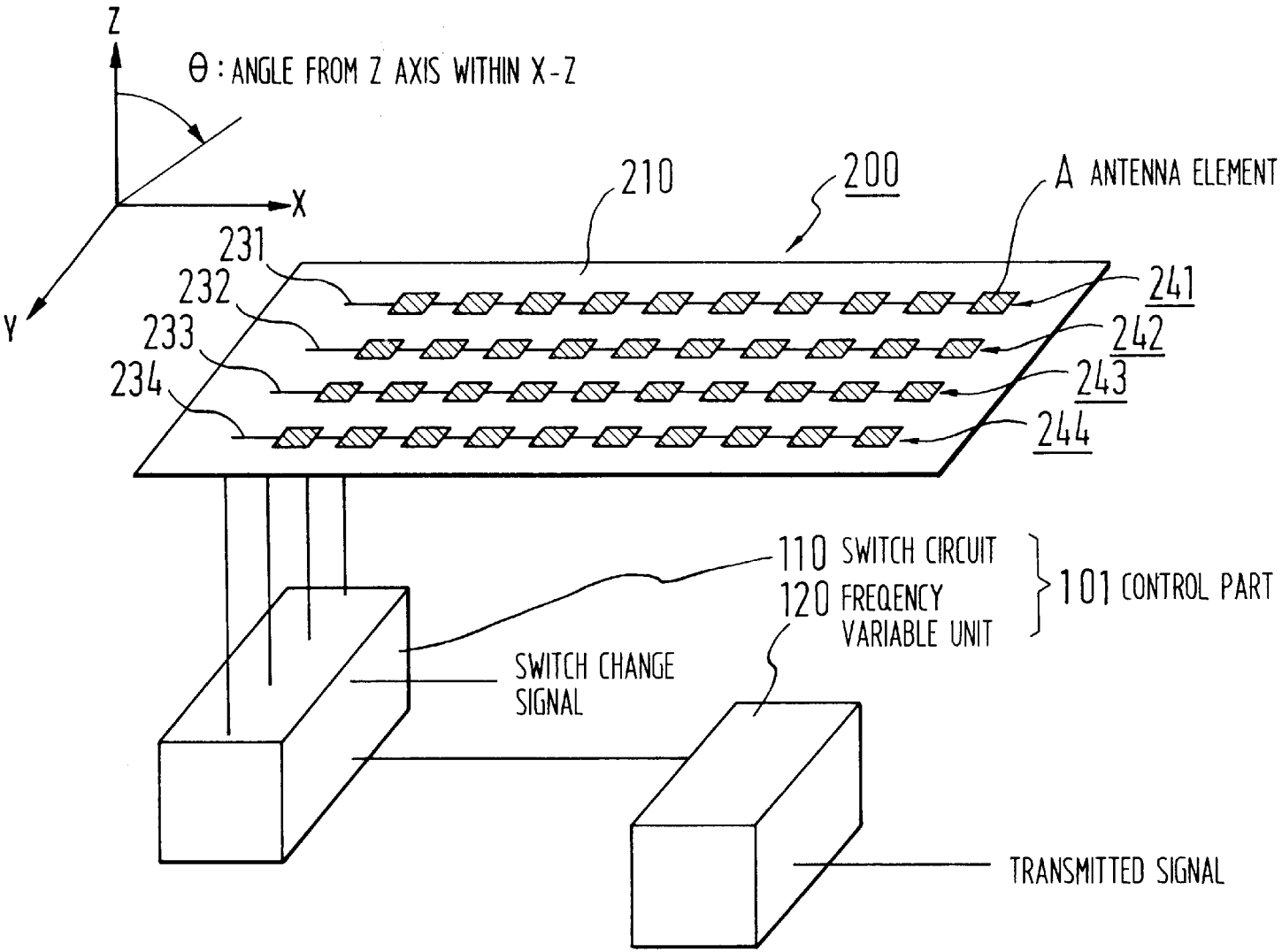
FIG. 3 illustrates array antenna apparatus in accordance with a second embodiment of the invention.

Next, array antenna apparatus in accordance with a second embodiment of this invention is described with reference to FIG. 3. In FIG. 3, elements that are the same as in FIG. 1 are identified by the same reference numerals, and an explanation of only the different features in FIG. 3 is provided. The array antenna apparatus of FIG. 3 comprises a control part 101 and the antenna part 200, the apparatus of FIG. 3 differs from that of FIG. 1 in the inclusion of the frequency variable vessel 120 in the control part 101. The frequency of the transmitted signal from a transmitting vessel (not shown) is changed arbitrarily, and the frequency variable vessel 120 outputs the transmitted signal to the switch circuit 110.

Hereafter, operation of the array antenna apparatus of the second embodiment is explained.

Frequency is controlled by the frequency variable vessel 120. The transmitted signal from the transmitting vessel (not shown) is supplied through the vessel 120 to the array antenna selected by the switch circuit 110, and is emitted to space from each antenna element A of the selected array antenna.

Changing the frequency of the transmitted signal applied to the antenna elements A of the antenna array has the effect of changing the phase of the signal and thereby changing the direction of the beam that is formed, thus, there is a correspondence between frequency and phase.

Here, if the array antenna 241 is chosen, for example, frequency is changed and a transmitted signal is supplied, since the phase of the transmitted signal in each antenna element A of the array antenna 241 changes, a beam inclination angle will change and, as a result, a beam scan will be performed.

With respect to, received signal generation from the radar echo from an observed object, the order operation is opposite to that carried out with transmission.

Thus, with the array antenna apparatus of the second embodiment, a beam can be scanned within the limits of the array antennas 241–244, and carrying out the variable control of the frequency of a transmitted signal with the frequency variable vessel 120.

Moreover, a beam can be alternatively scanned in four directions by changing the above-mentioned switch circuit 110. Therefore, according to the array antenna apparatus of the second embodiment, the beam scan of two or more ranges can be carried out, without using phase shifters.

Figure 4:
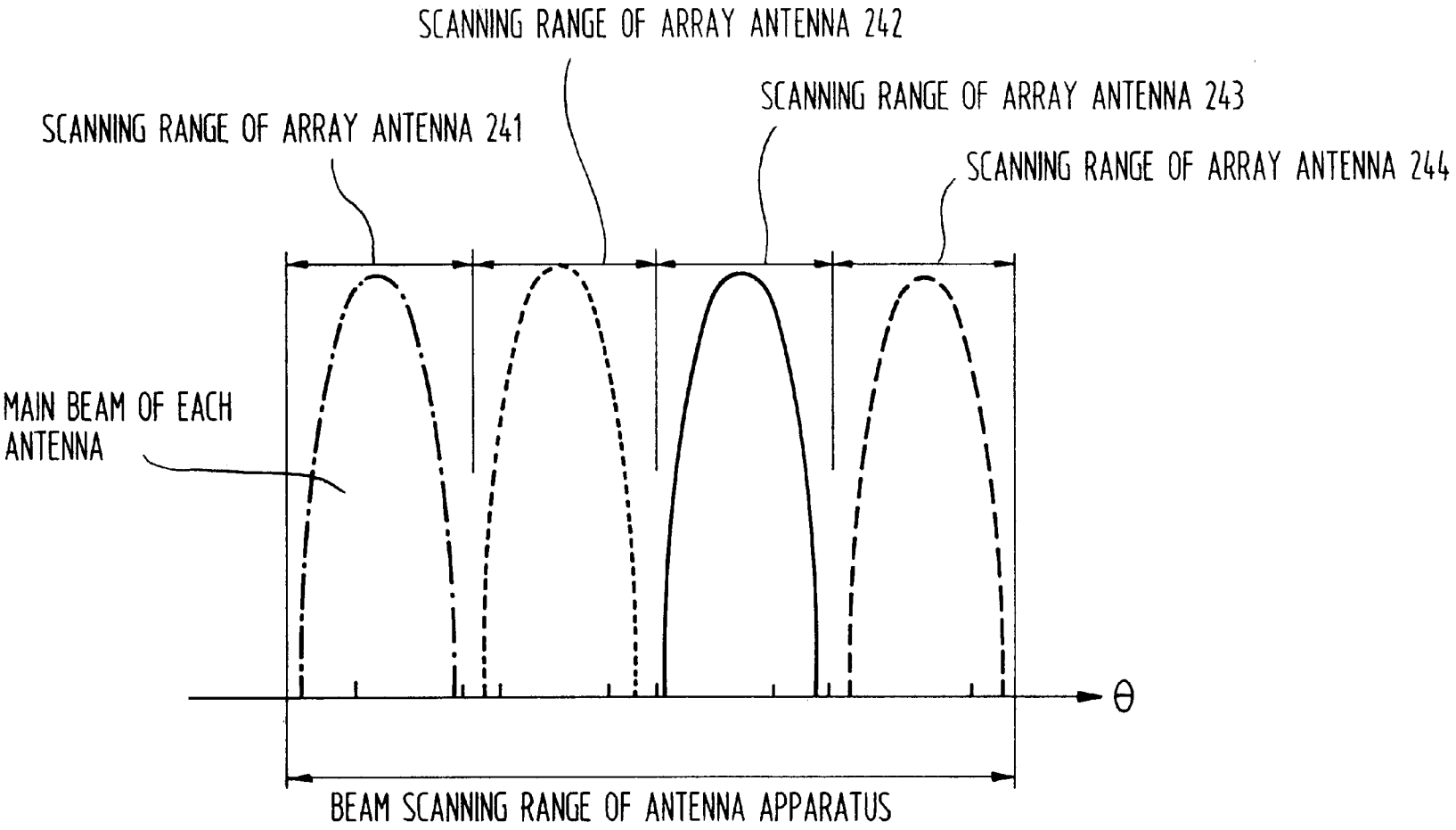
FIG. 4 illustrates an example of a setting of the beam scanning range of each array antenna of the second embodiment.

Moreover, if the scanning ranges of the respective antennas 241–244 are arranged to provide a continuous range taken together as shown in FIG. 4, the total beam scan can include the range of a beam scans of each array antenna 241–244 when carried out in a continuous sequence.

Figure 5:
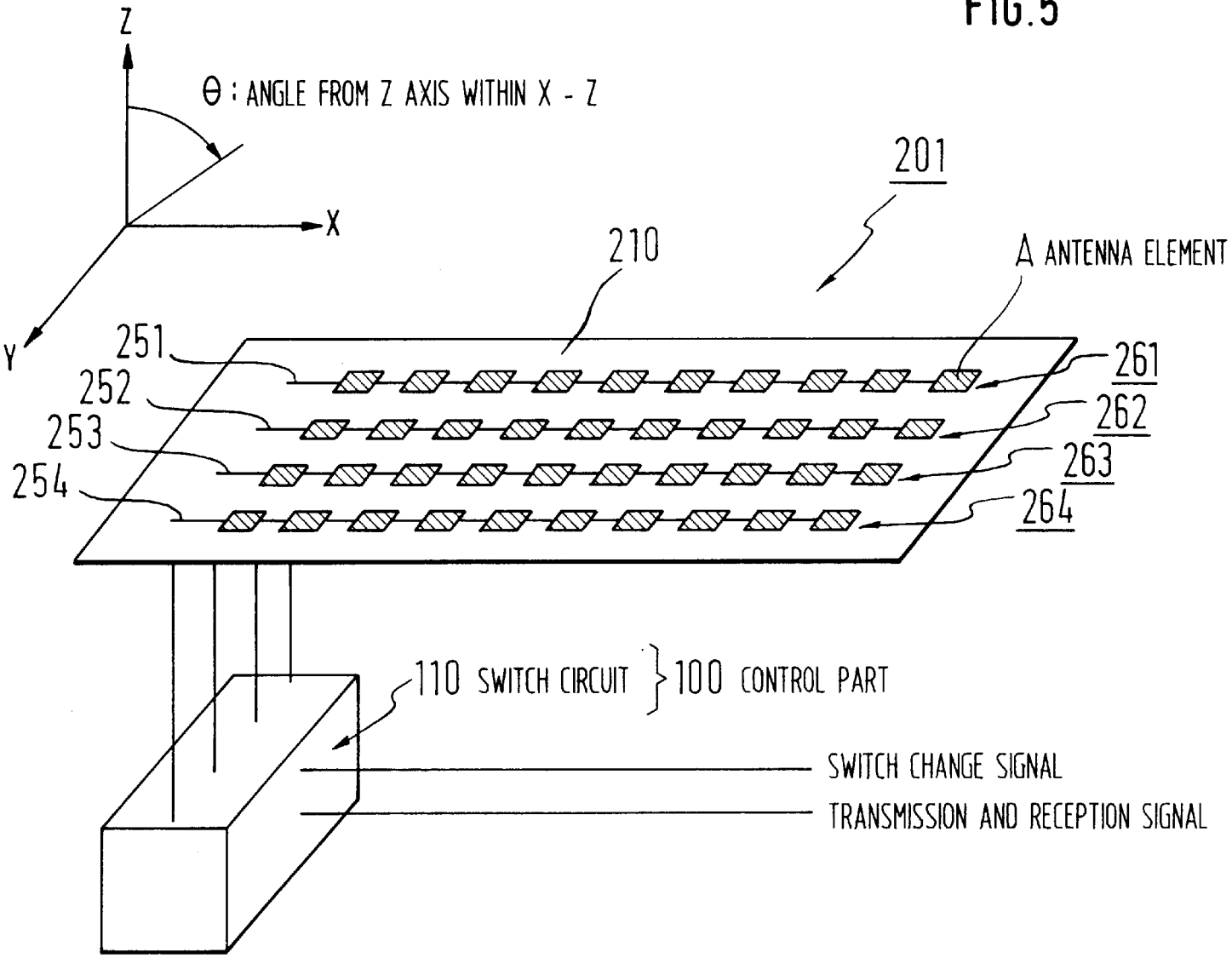
FIG. 5 illustrates array antenna apparatus in accordance with a third embodiment of the invention.

Next, array antenna apparatus in a accordance with third embodiment of the invention is described with reference to FIG. 5. In FIG. 5, elements that are the same as in FIG. 1 are identified by the same reference numerals, and an explanation of only the different features in FIG. 5 is provided. The features of the array antenna apparatus of the third embodiment include the control part 100 including switch circuit 110 and an antenna part 201 including array antennas 261–264. As in the case of the first embodiment, the elements of each of the array antennas 261–264 of the antenna part 201 are interconnected so that electrical signal power can be supplied in series on electric-supply tracks 251–254 to the antenna elements A distributed on the substrate 210.

Figure 6:
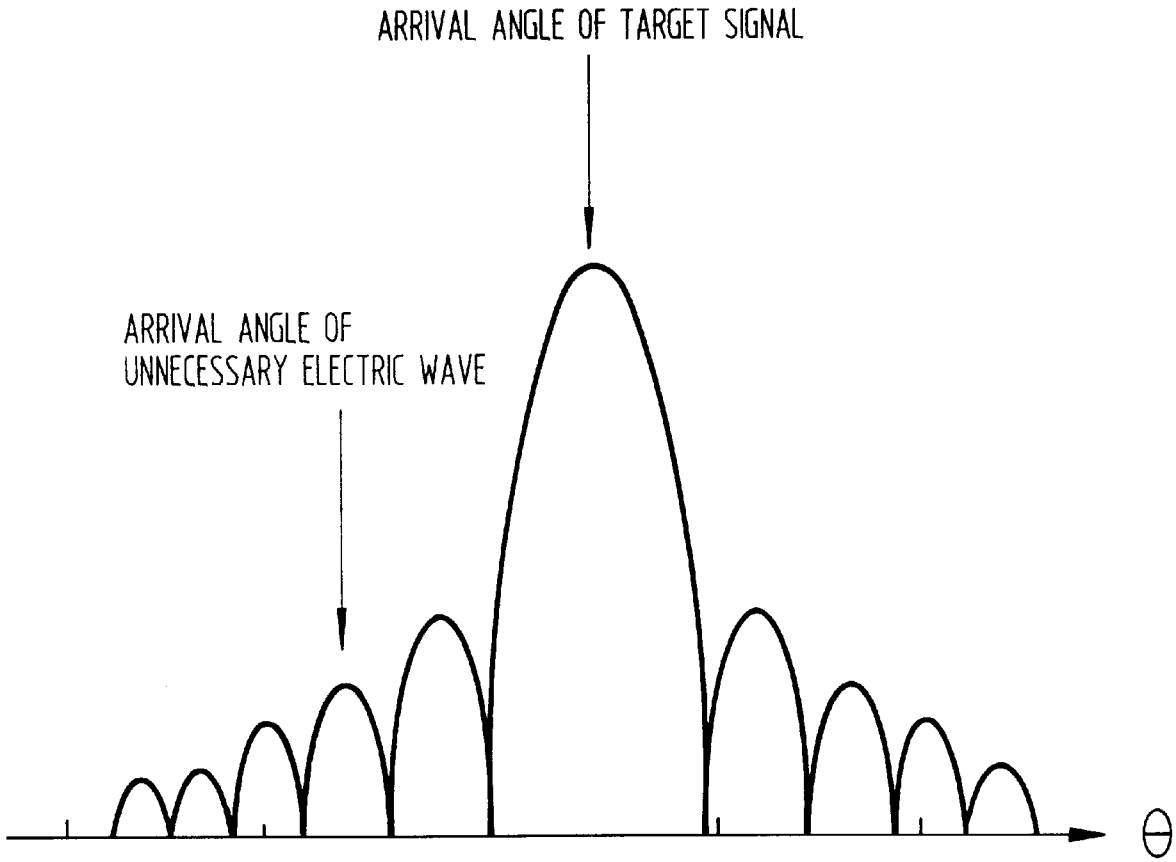
FIG. 6 illustrates a radiation pattern before antenna change control in the apparatus of the third embodiment.
Figure 7:
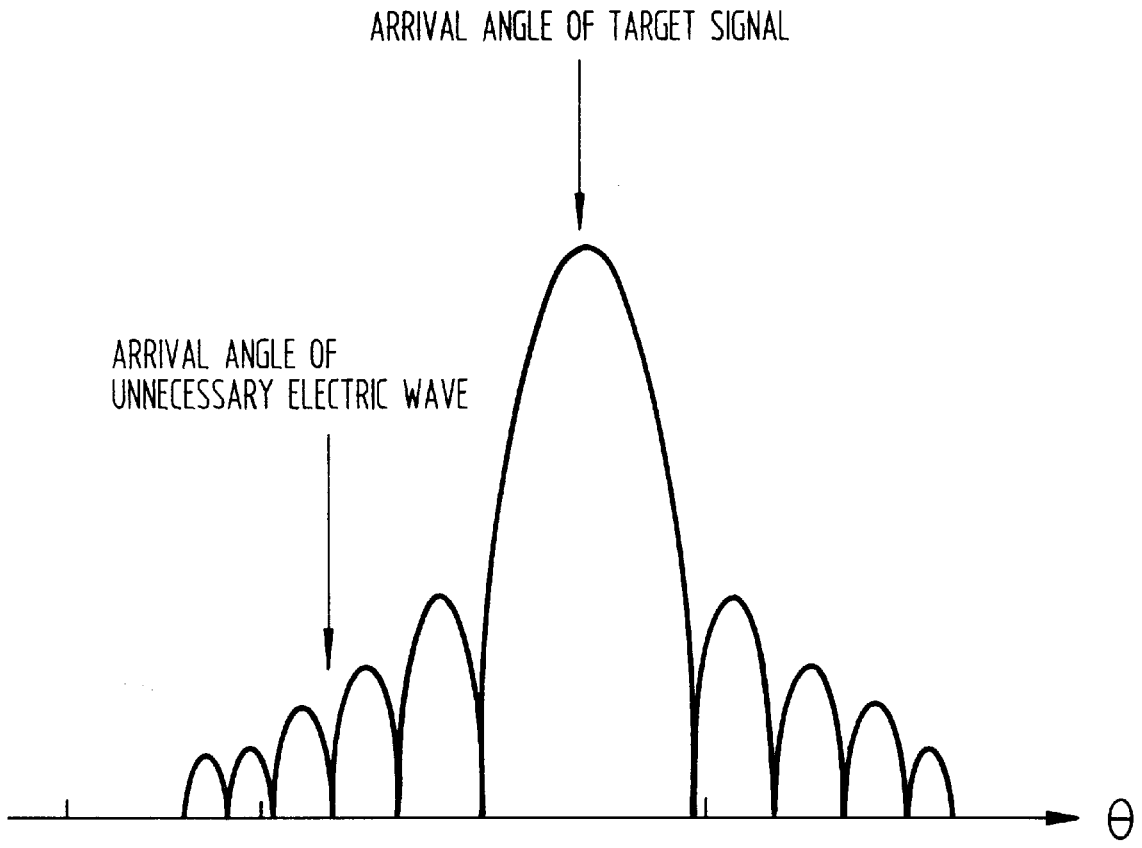
FIG. 7 illustrates a radiation pattern after antenna change control in the apparatus of the third embodiment.

However, the electric-supply track between the antenna elements A is changed, respectively, and the array antenna 261 and the array antenna 262 arranged so that a different null point may be formed by each antenna, although a main beam of the same form including the same inclination angle is formed by each of antennas 261 and 262, as shown in FIGS. 6 and 7.

Similarly, the antenna elements A of the array antenna 263 and the array antenna 264 are arranged so that each antenna forms a different null point, although the main beam of the same form including the same inclination angle is formed by each of antennas 263 and 264. However, the array antennas 261,262 and the array antennas 263,264 are respectively set up so that the main beam is formed with a different inclination angle.

Hereafter, operation of the array antenna apparatus of the third embodiment is explained.

The transmitted signal from a transmitting vessel (not shown) is supplied to the array antenna chosen by the switch circuit 110 according to the switch change signal. As a result, a transmitted signal is emitted from the array antenna selected by the switch change signal, and a main beam is formed with an inclination angle beforehand set up by this. If the array antenna 261 and the array antenna 263 are switched alternatively for this reason, a beam can be formed in two directions.

As for received signal generation from a radar echo or from an observed object, the order of processing is opposite to that carried out for the transmission.

Here, when having received a radar echo, for example, using the array antenna 261 and an unnecessary electric wave occurs the apparatus on a side lobe of the array antenna 261 as shown in FIG. 6, switches to the array antenna 262 by means of the switch circuit 110. Thereby, as shown in FIG. 7, the unnecessary electric wave is hardly received, because the magnitude of the unnecessary wave is reduced by the null point of antenna 262.

Therefore, according to the array antenna apparatus of the second embodiment, without using phase shifters, a beam can be formed in two different directions. Also if an unnecessary electric wave occurs on a side lobe direction of the selected array antenna apparatus, reception of the unnecessary electric wave can be reduced by switching to the array antenna having the same inclination angle of its main beam and a null point that differs in position.

In addition, in the third embodiment, if it is modified to output a transmitted signal to the switch circuit 110 through the frequency variable vessel 120 of the second embodiment, a beam scan with a reduction of unnecessary electric-wave reception will be attained by frequency control of the transmitted signal.

Moreover, if it is made to continue the beam scanning range of each array antenna, it can scan cross broadly and a beam can be scanned continuously.

Figure 8:
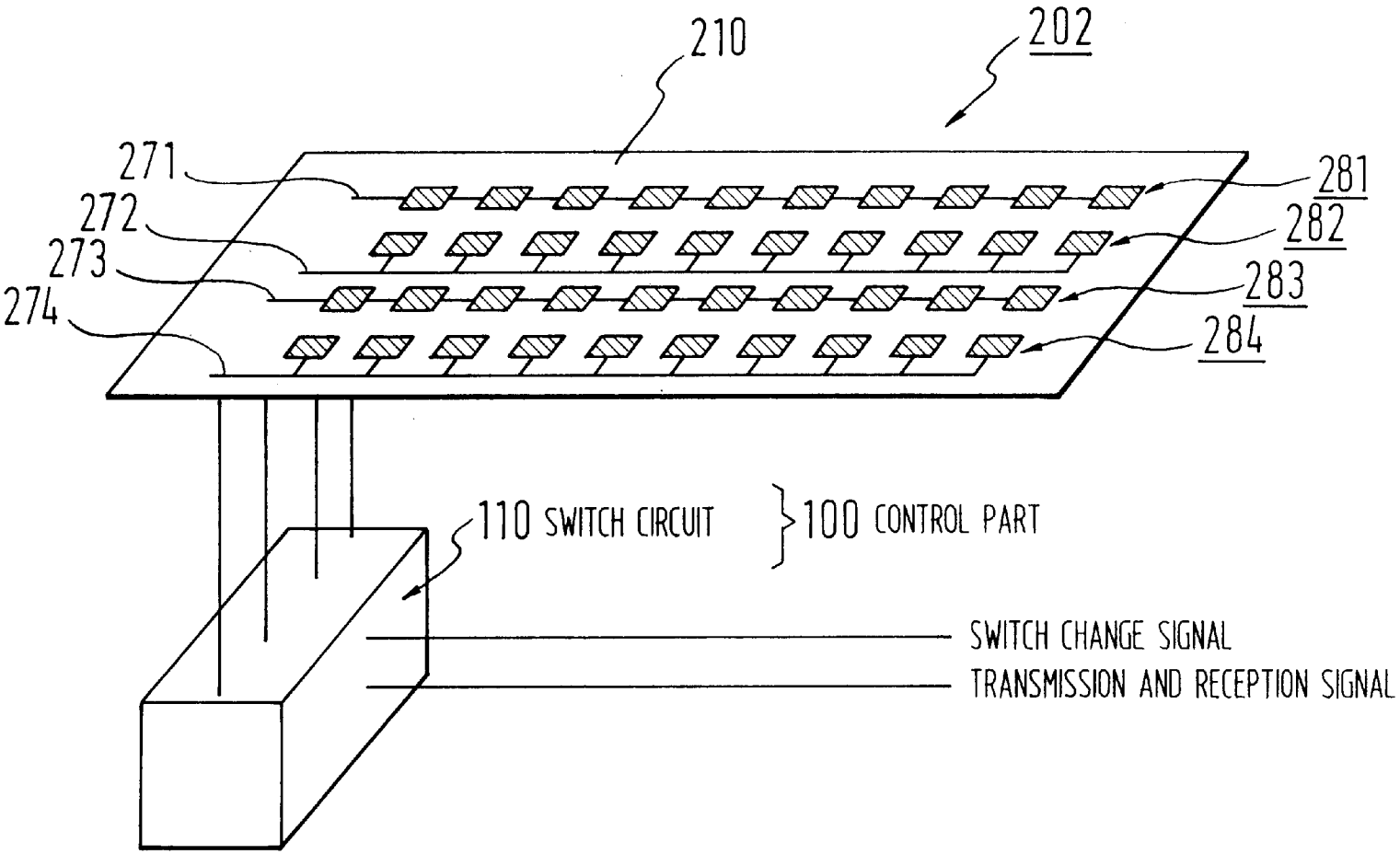
FIG. 8 illustrates array antenna apparatus in accordance with a fourth embodiment of the invention.
Figure 9:
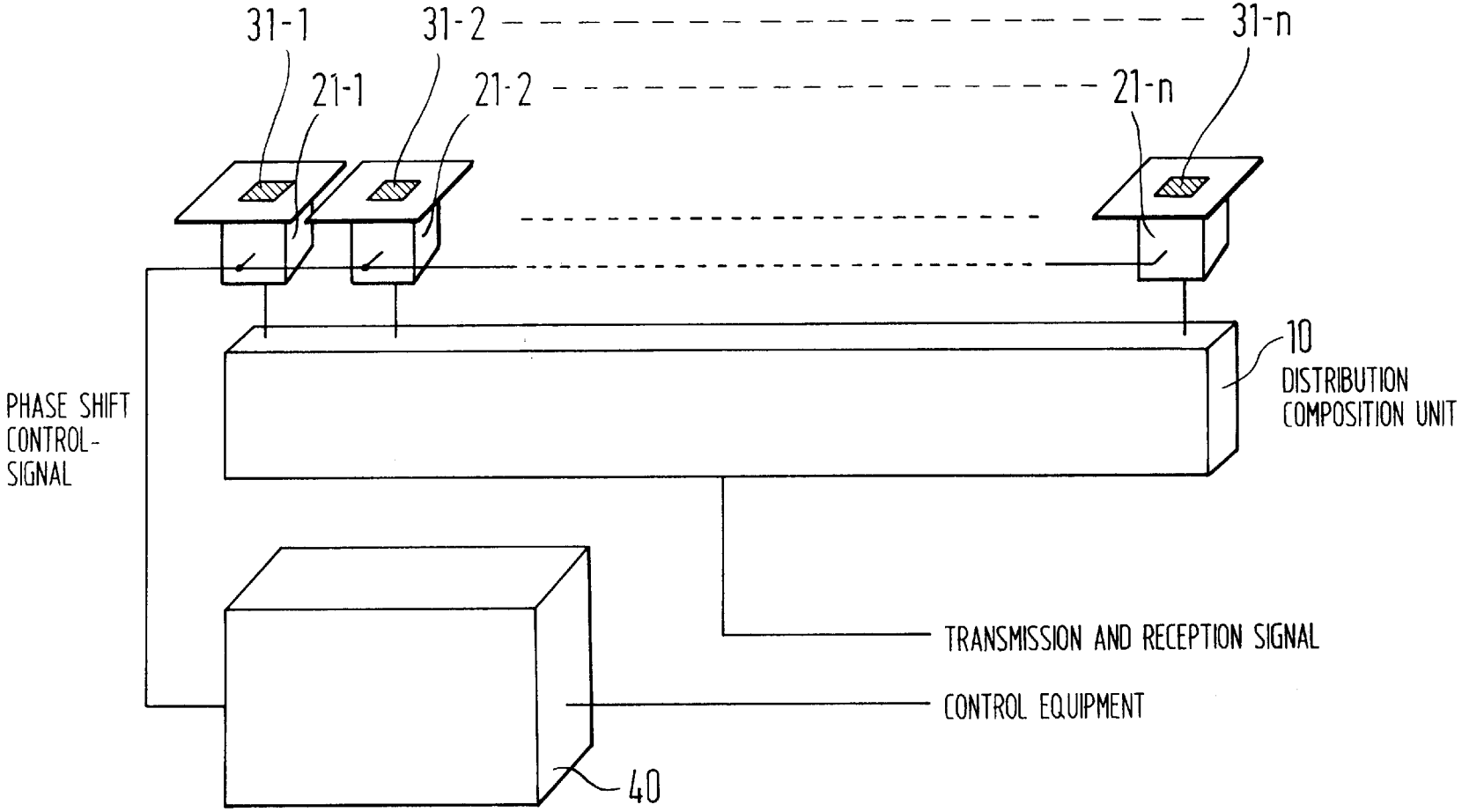
FIG. 9 illustrates conventional array antenna apparatus using phase shifters.
Figure 10:
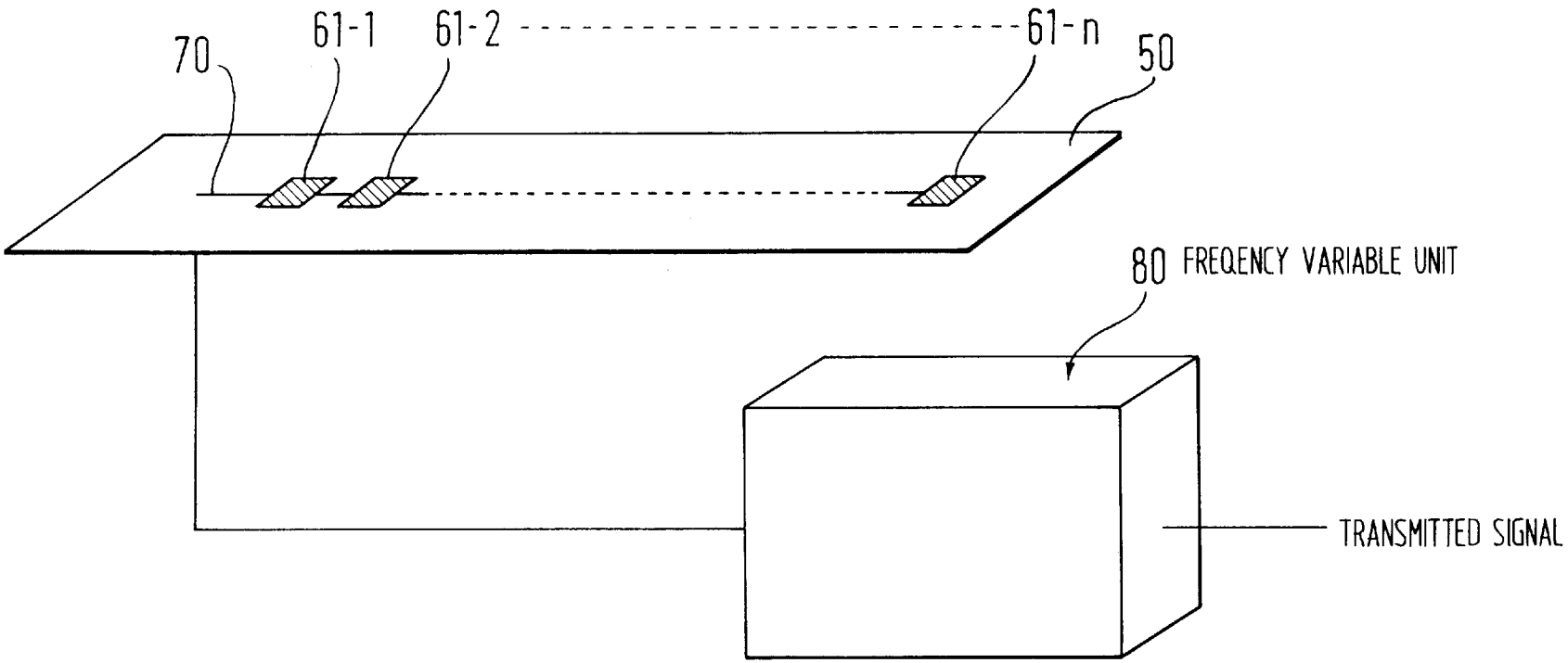
FIG. 10 illustrates conventional array antenna apparatus using a frequency variable vessel.

Next, array antenna apparatus of a fours embodiment of the invention is described to FIG. 8.

In FIG. 8, elements that are the same as a FIG. 1 are identified by the same reference numerals, and an explanation of only the different features of FIG. 8 is provided.

The features of the array antenna apparatus of the fourth embodiment include the control part 100 including the switch circuit 110 and an antenna part 202 including array antennas 281–284. The elements of the array antenna 281 and the array antenna 283 of the antenna part 202 are interconnected so that electrical signal power can be supplied in series on an electric-supply track 271 and an electric-supply track 273 to antenna elements A distributed on the substrate 210 as in the first embodiment. The elements of the array antenna 282 and the array antenna 284 are connected in parallel to receive electrical signal power and arranged so that electrical signal power may be supplied from a direction which is perpendicular to the direction of series connected electrical power supply. The array antenna 282,284 antenna elements A are distributed on the substrate 210, respectively, on the electric-supply track 272 and the electric-supply track 274, respectively.

Moreover, the array antenna 281 and the array antenna 282 are set up so that the beams by these polarizations may be formed on the same inclination square while generating polarizations which intersect perpendicularly mutually due to the above described electrical supply connections to the antennas.

The array antenna 283 and the array antenna 284 are set up with the same relation as described for antennas 281 and 282. However, the group of the array antennas 281,282 and the group of the array antennas 283,284 are set up so that the beam of one group can be formed with an inclination angle which differs from that of the other group.

Hereafter, operation of the array antenna apparatus of the four the embodiment is explained. A transmitted signal is supplied to the array antenna chosen by the switch circuit 110 according to the switch change signal, and is emitted into space.

Thereby, a beam is formed with an inclination angle set up beforehand for the selected array antenna.

For example, if the array antenna 281 and the array antenna 283 are switched alternatively, a beam can be alternatively formed in two directions.

Moreover, if the array antenna 282 and the array antenna 284 are also switched alternatively, the array antenna 281 and the array antenna 283 can form alternatively a beam having a polarization which intersects perpendicularly, to the different two directions. Therefore, while a beam can be alternatively formed in two different directions according to the array antenna apparatus of the fourth embodiment, without using phase shifters, it can also switch to a polarization which intersects perpendicularly with each beam.

In addition, in the operation of the fourth embodiment, if it is modified to output a transmitted signal to the switch circuit 110 through the frequency variable vessel 120 of the second embodiment, a beam scan can also be carried out with a beam which a selected array antenna forms by frequency control.

Moreover, a beam scan of large area can also be carried out, by switching alternatively the range in which a beam scan of each array antenna with possible polarization which intersects perpendicularly, if it is made to continue.

Moreover, although the above case of operation explained the array antenna which used the discrete, patch antenna elements, it can be similarly carried out with an antenna using other antenna elements (for example, slot antenna elements) which can control a beam inclination angle.

Additional advantages and modifications will readily occur to those skilled in the art. The invention in its broader aspects is therefore not limited to the specific details, representative apparatus and method, and illustrative examples shown and described. Accordingly, departures may be made from such details without departing from the spirit or scope of the general inventive concept.

Thus, it is intended that this invention cover the modifications and variations of the invention provided they are within the scope of the appended claims and their equivalents.

We claim:

1. Array antenna apparatus, comprising:

a first array antenna including a first plurality of antenna elements connected in series to conduct electrical power applied thereto;

a second array antenna including a second plurality of antenna elements connected in parallel; and a switch circuit for selectively directing transmission signals to the first and second array antennas and received signals from the first and second array antennas and for determining a polarization of the first and second array antennas by selecting one of the first or second array antennas.

2. The array antenna apparatus of claim 1 wherein the first and second array antennas have a first beam inclination angle; said array antenna apparatus further including:

a third array antenna including a third plurality of antenna elements connected in series to conduct electrical power applied thereto;

a fourth array antenna including a fourth plurality of antenna elements connected in parallel, said third and fourth array antennas having a second beam inclination angle; and said switch circuit coupled to also selectively direct transmission signals to said third and fourth array antennas and received signals from said third and fourth array antennas.

* * * * *